US008770003B2

(12) United States Patent
Sasaki

(10) Patent No.: US 8,770,003 B2
(45) Date of Patent: Jul. 8, 2014

(54) METHOD FOR PRODUCING SEAMLESS PIPE AND METHOD FOR DETERMINING LENGTH OF BILLET FOR USE IN PRODUCING SEAMLESS PIPE

(75) Inventor: Kenichi Sasaki, Wakayama (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 965 days.

(21) Appl. No.: 12/883,887

(22) Filed: Sep. 16, 2010

(65) Prior Publication Data

US 2011/0056263 A1 Mar. 10, 2011

Related U.S. Application Data

(63) Continuation of application No. PCT/JP2008/069672, filed on Oct. 29, 2008.

(30) Foreign Application Priority Data

Mar. 25, 2008 (JP) ..... 2008-077828

(51) Int. Cl.
*B21B 1/00* (2006.01)

(52) U.S. Cl.
USPC ..... 72/203; 72/365.2

(58) Field of Classification Search
USPC ..... 72/6.1, 6.2, 97, 203, 365.2, 129, 185, 72/200, 202, 324
See application file for complete search history.

(56) References Cited

U.S. PATENT DOCUMENTS

| | | | | | |
|---|---|---|---|---|---|
| 3,841,180 | A | * | 10/1974 | Gutlbauer et al. | 83/15 |
| 4,397,169 | A | * | 8/1983 | Staat | 72/9.2 |
| 5,125,250 | A | * | 6/1992 | Sun | 72/8.5 |
| 5,402,663 | A | * | 4/1995 | Rit et al. | 72/11.5 |
| 5,957,367 | A | * | 9/1999 | Matsuo et al. | 228/158 |
| 6,024,808 | A | * | 2/2000 | Kondo et al. | 148/541 |

FOREIGN PATENT DOCUMENTS

| | | | | | |
|---|---|---|---|---|---|
| JP | 56-105430 | A | * | 8/1981 | C21D 11/00 |
| JP | 60-187429 | A | * | 9/1985 | B21C 51/00 |
| JP | 63-149004 | A | | 6/1988 | |
| JP | 9-217112 | A | * | 8/1997 | C21D 1/00 |
| JP | 2001-105012 | A | | 4/2001 | |
| JP | 2002-309316 | A | * | 10/2002 | C21D 9/00 |
| JP | 2004-61273 | A | | 2/2004 | |
| JP | 2006-281252 | A | | 10/2006 | |
| JP | 2007-224373 | A | * | 9/2007 | C21D 9/00 |

OTHER PUBLICATIONS

Machine translation of JP 2007-224373, Sep. 2007.*
English translation of the International Preliminary Report on Patentability for PCT/JP2008/069672, dated Nov. 18, 2010.
International Search Report in corresponding PCT/JP2008/069672 dated Jan. 20, 2009.

* cited by examiner

*Primary Examiner* — Edward Tolan
(74) *Attorney, Agent, or Firm* — Marshall, Gerstein & Borun LLP

(57) ABSTRACT

Seamless pipes are produced by using billets for which the length L of a parent billet, the lengths l of child billets and the number $n_B$ of the obtainable child billets are determined on the basis of predetermined tolerances and the conditions of a billet-heating furnace and billet-rolling facilities. In this way, energy saving in the production of seamless pipes can be realized and the productivity in the production of seamless pipes can also be improved.

2 Claims, 1 Drawing Sheet

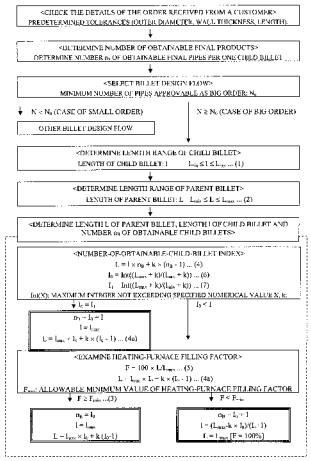

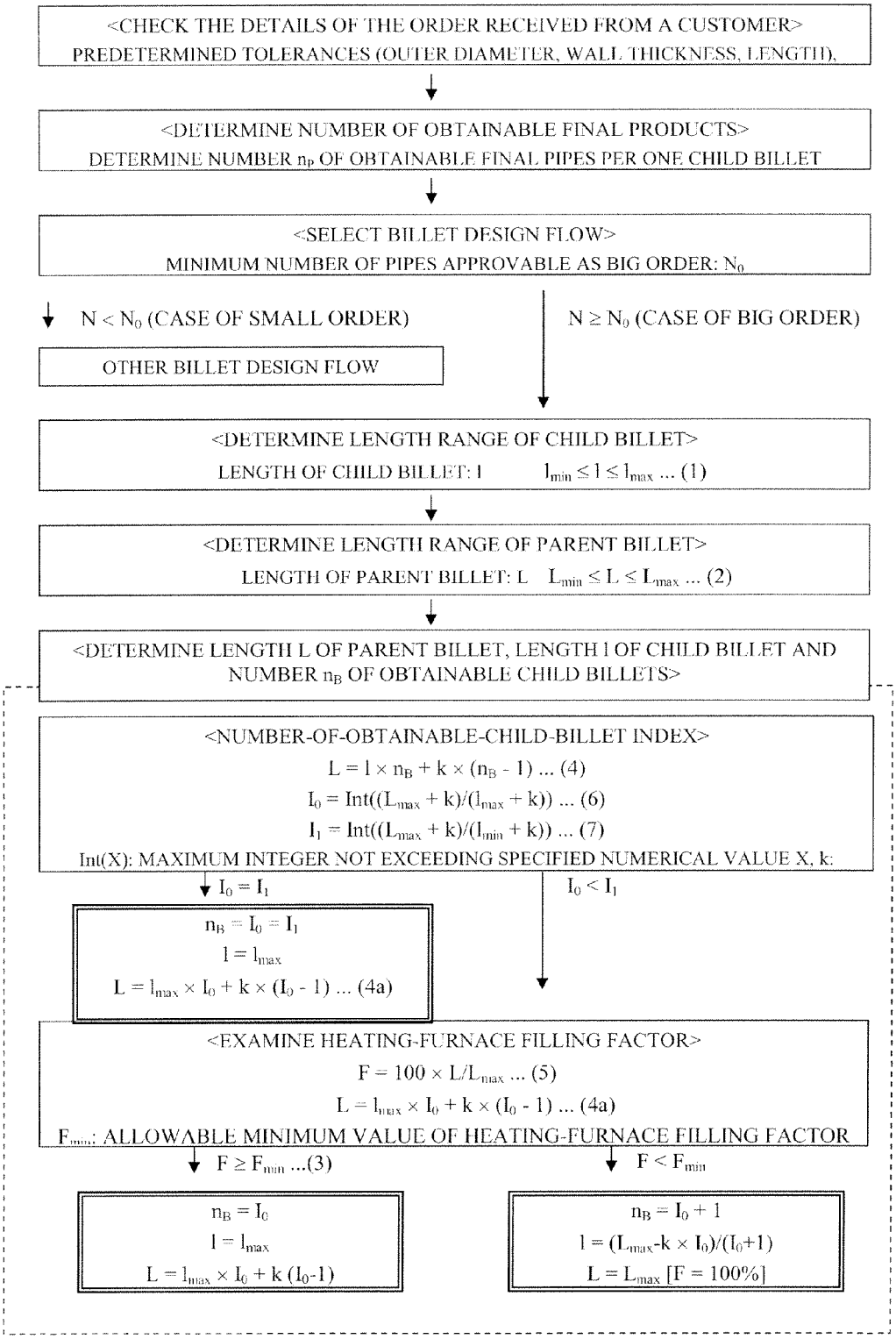
<CHECK THE DETAILS OF THE ORDER RECEIVED FROM A CUSTOMER>
PREDETERMINED TOLERANCES (OUTER DIAMETER, WALL THICKNESS, LENGTH),
<DETERMINE NUMBER OF OBTAINABLE FINAL PRODUCTS>
DETERMINE NUMBER $n_P$ OF OBTAINABLE FINAL PIPES PER ONE CHILD BILLET
<SELECT BILLET DESIGN FLOW>
MINIMUM NUMBER OF PIPES APPROVABLE AS BIG ORDER: $N_0$
$N < N_0$ (CASE OF SMALL ORDER)
$N \geq N_0$ (CASE OF BIG ORDER)
OTHER BILLET DESIGN FLOW
<DETERMINE LENGTH RANGE OF CHILD BILLET>
LENGTH OF CHILD BILLET: l $l_{min} \leq l \leq l_{max}$ ... (1)
<DETERMINE LENGTH RANGE OF PARENT BILLET>
LENGTH OF PARENT BILLET: L $L_{min} \leq L \leq L_{max}$ ... (2)
<DETERMINE LENGTH L OF PARENT BILLET, LENGTH l OF CHILD BILLET AND NUMBER $n_B$ OF OBTAINABLE CHILD BILLETS>
<NUMBER-OF-OBTAINABLE-CHILD-BILLET INDEX>
$L = l \times n_B + k \times (n_B - 1)$ ... (4)
$I_0 = Int((L_{max} + k)/(l_{max} + k))$ ... (6)
$I_1 = Int((L_{max} + k)/(l_{min} + k))$ ... (7)
Int(X): MAXIMUM INTEGER NOT EXCEEDING SPECIFIED NUMERICAL VALUE X, k:
$I_0 = I_1$
$I_0 < I_1$
$n_B = I_0 = I_1$
$l = l_{max}$
$L = l_{max} \times I_0 + k \times (I_0 - 1)$ ... (4a)
<EXAMINE HEATING-FURNACE FILLING FACTOR>
$F = 100 \times L/L_{max}$ ... (5)
$L = l_{max} \times I_0 + k \times (I_0 - 1)$ ... (4a)
$F_{min}$: ALLOWABLE MINIMUM VALUE OF HEATING-FURNACE FILLING FACTOR
$F \geq F_{min}$ ...(3)
$F < F_{min}$
$n_B = I_0$
$l = l_{max}$
$L = l_{max} \times I_0 + k (I_0-1)$
$n_B = I_0 + 1$
$l = (L_{max}-k \times I_0)/(I_0+1)$
$L = L_{max}$ [F = 100%]

METHOD FOR PRODUCING SEAMLESS PIPE AND METHOD FOR DETERMINING LENGTH OF BILLET FOR USE IN PRODUCING SEAMLESS PIPE

The disclosure of International Application No. PCT/JP2008/069672 filed Oct. 29, 2008 including specification, drawings and claims is incorporated herein by reference in its entirety.

TECHNICAL FIELD

The present invention relates to a method for producing a seamless pipe and a method for determining the length of a billet to be used in the production of a seamless pipe.

BACKGROUND ART

Various methods have been known as the methods for producing seamless steel pipes. For example, the Mannesmann-mandrel mill method is a method in which a heated billet is subjected to piercing-rolling with a piercing mill, an elongation rolling with a mandrel mill, and further to a sizing with a sizing mill or the like.

The applicant has disclosed in Patent Document 1, with respect to the method for determining the dimension of a billet, an invention of "a method for producing a seamless steel pipe which method is provided with a rolling mill capable of regulating the dimension of a product and in which method a seamless steel pipe is produced in a production line with a cutting machine disposed downstream of a heating furnace, wherein: even when the products to be produced are different in dimension from each other, the stocks for the products are collected into groups so as for each of the groups to consist of the same type of stocks; in each of the groups, the stocks each ensure the stock length that is equal to or longer than the minimum length constrained by the stock type; and in each of the groups, the thus qualified stocks are conveyed and heated and then cut to required lengths with a cutting machine, and then the cut stocks are rolled so as to have the predetermined product dimensions."

Patent Document 1: JP2001-105012A

DISCLOSURE OF THE INVENTION

Problems to be Solved by the Invention

The invention described in Patent Document 1 is for the purpose of suppressing the production yield loss incurred in the case where, when the length of a billet is determined according to the order of a small lot of products, the length of the billet has to be set to be longer than needed because of the minimum value constrained due to conveyer transfer or the like. In this invention, for a small lot of products different in product dimension from each other, the lengths of the billets concerned are determined collectively to produce unfinished products, and the unfinished products are heated and then cut to obtain the products. This invention enables to solve the problem of the yield loss in the production of a small lot of products.

However, when there is received an order of a large lot of products requiring preparation of a large amount of billets having the same length, adoption of the above-described method is precluded. This is because the determination of the lengths of the billets by means of the above-described method causes a problem that the filling factor of a heating furnace is deteriorated due to the constraint from the furnace width. The deterioration of the billet filling factor in the heating furnace increases energy loss and, at the same time, causes a problem that the heat treatment of the billets is not ready in time for the pitch of the piercing-rolling in the next step and hence the productivity is deteriorated.

An object of the present invention is to provide a method for producing a seamless pipe which method enables to increase the billet filling factor in a heating furnace so as to realize energy saving and at the same time, enables to improve productivity, and a method for determining the length of a billet for use in production of a seamless pipe.

Means for Solving the Problems

The present invention has been achieved in order to solve the above-described problems, and the gist of the present invention resides in the method for producing a seamless pipe described in the following [1] and [2] and the method for determining the length of a billet for use in production of a seamless pipe described in the following [3] to [4].

[1] A method for producing a seamless pipe including steps of a billet-heating process, a billet-cutting process, a piercing-rolling process and elongation-rolling process, wherein the method using the billets satisfying the following formulas (1) to (3):

$$l_{min} \le l \le l_{max} \quad (1)$$

$$L_{min} \le L \le L_{max} \quad (2)$$

$$F \ge F_{min} \quad (3)$$

wherein L is the length (m) of the parent billet and is represented by the following formula (4), and F is the billet-heating-furnace filling factor (%) and is represented by the following formula (5):

$$L = l \times n_B + k \times (n_B - 1) \quad (4)$$

$$F = 100 \times L / L_{max} \quad (5)$$

wherein in the above-described formulas, the meanings of the individual symbols are as follows:

$L_{min}$: The minimum length (m) of the parent billet allowed on the basis of the conditions of the billet-heating furnace $L_{max}$: The maximum length (m) of the parent billet allowed on the basis of the conditions of the billet-heating furnace l: The length (m) of the child billet $l_{min}$: The minimum value (m) of the length of the child billet allowed on the basis of the predetermined tolerances and the rolling conditions $l_{max}$: The maximum value (m) of the length of the child billet allowed on the basis of the predetermined tolerances and the rolling conditions k: Billet cutting margin (m)

$n_B$: The number (number of pieces) of the child billets obtainable from one piece of parent billet $F_{min}$: The allowable minimum value (%) of the heating-furnace filling factor

[2] The method for producing a seamless pipe, according to [1], the method adopting the following respective values in the following respective cases (A) to (C) in each of which the relation between the number-of-obtainable-billet indexes $I_0$ and $I_1$ calculated respectively from the following formulas (6) and (7) is specified.

(A) A case where $I_0 = I_1$:

L obtained by substituting $n_B = I_0$ and $l = l_{max}$ into the above-described formula (4) is adopted as the length L of the parent billet, $l_{max}$ is adopted as the length l of the child billet, and $I_0$ is adopted as the number $n_B$ of the obtainable child billets.

(B) A case where $I_0<I_1$, and F satisfies the above-described formula (3) wherein F is obtained by substituting, into the above-described formula (5), L obtained by substituting $n_B=I_0$ and $l=l_{max}$ into the above-described formula (4):

L obtained by substituting $n_B=I_0$ and $l=l_{max}$ into the above-described formula (4) is adopted as the length L of the parent billet, $l_{max}$ is adopted as the length l of the child billet, and $I_0$ is adopted as the number $n_B$ of the obtainable child billets.

(C) A case where $I_0<I_1$, and F does not satisfy the above-described formula (3) wherein F is obtained by substituting, into the above-described formula (5), L obtained by substituting $n_B=I_0$ and $l=l_{max}$ into the above-described formula (4):

$L_{max}$ is adopted as the length L of the parent billet, $(L_{max}-k\times(n_B-1))/n_B$ is adopted as the length l of the child billet, and $I_0+1$ is adopted as the number $n_B$ of the obtainable child billets.

$$I_0=Int((L_{max}+k)/(l_{max}+k)) \quad (6)$$

$$I_1=Int((L_{max}+k)/(l_{min}+k)) \quad (7)$$

wherein Int(X) means the maximum integer that does not exceed the specified numerical value X.

[3] A method for determining the length of a billet for use in a seamless pipe, wherein the length of the billet is determined so as to satisfy the following formulas (1) to (3):

$$l_{min}\leq l\leq l_{max} \quad (1)$$

$$L_{min}\leq L\leq L_{max} \quad (2)$$

$$F\geq F_{min} \quad (3)$$

wherein L is the length (m) of the parent billet and is represented by the following formula (4), and F is the billet-heating-furnace filling factor (%) and is represented by the following formula (5):

$$L=l\times n_B+k\times(n_B-1) \quad (4)$$

$$F=100\times L/L_{max} \quad (5)$$

wherein in the above-described formulas, the meanings of the individual symbols are as follows:

$L_{min}$: The minimum length (m) of the parent billet allowed on the basis of the conditions of the billet-heating furnace $L_{max}$: The maximum length (m) of the parent billet allowed on the basis of the conditions of the billet-heating furnace l: The length (m) of the child billet $l_{min}$: The minimum value (m) of the length of the child billet allowed on the basis of the predetermined tolerances and the rolling conditions $l_{max}$: The maximum value (m) of the length of the child billet allowed on the basis of the predetermined tolerances and the rolling conditions k: Billet cutting margin (m)

$n_B$: The number (number of pieces) of the child billets obtainable from one piece of parent billet $F_{min}$: The allowable minimum value (%) of the heating-furnace filling factor

[4] The method for determining the length of a billet for use in a seamless pipe, according to [3], the method adopting the following respective values in the following respective cases (A) to (C) in each of which the relation between the number-of-obtainable-billet indexes $I_0$ and $I_1$ calculated respectively from the following formulas (6) and (7) is specified.

(A) A case where $I_0=I_1$:

L obtained by substituting $n_B=I_0$ and $l=l_{max}$ into the above-described formula (4) is adopted as the length L of the parent billet, $l_{max}$ is adopted as the length l of the child billet, and $I_0$ is adopted as the number $n_B$ of the obtainable child billets.

(B) A case where $I_0<I_1$, and F satisfies the above-described formula (3) wherein F is obtained by substituting, into the above-described formula (5), L obtained by substituting $n_B=I_0$ and $l=l_{max}$ into the above-described formula (4):

L obtained by substituting $n_B=I_0$ and $l=l_{max}$ into the above-described formula (4) is adopted as the length L of the parent billet, $l_{max}$ is adopted as the length l of the child billet, and $I_0$ is adopted as the number $n_B$ of the obtainable child billets.

(C) A case where $I_0<I_1$, and F does not satisfy the above-described formula (3) wherein F is obtained by substituting, into the above-described formula (5), L obtained by substituting $n_B=I_0$ and $l=l_{max}$ into the above-described formula (4):

$L_{max}$ is adopted as the length L of the parent billet, $(L_{max}-k\times(n_B-1))/n_B$ is adopted as the length l of the child billet, and $I_0+1$ is adopted as the number $n_B$ of the obtainable child billets.

$$I_0=Int((L_{max}+k)/(l_{max}+k)) \quad (6)$$

$$I_1=Int((L_{max}+k)/(l_{min}+k)) \quad (7)$$

wherein Int(X) means the maximum integer that does not exceed the specified numerical value X.

Advantage of the Invention

According to the present invention, the billet filling factor in the heating furnace can be increased, and hence the energy saving in the production of seamless pipes can be realized, and the productivity in the production of seamless pipes can also be improved.

BRIEF DESCRIPTION OF THE DRAWING

FIG. 1 is a diagram showing a billet design flow of the present invention.

BEST MODE FOR CARRYING OUT THE INVENTION

In the method for producing a seamless pipe according to the present invention, for example, a heated long length billet (hereinafter referred to as a "parent billet") is cut to obtain short length billets (hereinafter referred to as "child billets"), and then the child billets are subjected to piercing-rolling, elongation rolling and sizing to obtain seamless pipes. The obtained seamless pipes are usually further cut to appropriate sizes.

In the method for producing a seamless pipe according to the present invention, for example, seamless pipes are produced from the child billets obtained by cutting the heated parent billet into two pieces, and the seamless pipes are each further cut into two pieces to obtain final products. In this case, the dimension of the parent billet is designed so as to be the dimension corresponding to four pieces of the final products.

It is to be noted that the "parent billet" is usually a billet before cutting, and hence the "parent billet" can also be defined as the "billet before cutting," and the "child billet" can also be defined as the "billet after cutting," as the case may be. However, depending on the conditions including the predetermined tolerances and others, the billet after heating is subjected to the pipe-making step without cutting as the case may be. In this case, the "parent billet" means the same billet as the "child billet."

FIG. 1 is a diagram showing a billet design flow of the present invention. As shown in FIG. 1, in the billet design flow of the present invention, first the details of the order received from a customer are checked, and then on the basis of the predetermined tolerances (for example, the tolerances for the outer diameter, wall thickness and length specified by a customer) and the number of the ordered pieces N, the number $n_P$ of the obtainable final products per one child billet is determined. In this connection, preferable is a case where the order is a small lot order, namely, a case where the number of the ordered pieces N is larger than the predetermined minimum number of pieces $N_0$. The minimum number of pieces $N_0$ can be determined on the basis of the capacity of the production facilities. For example, in the case of the production facilities having a production capacity of approximately 50000 tons per month, the minimum number of pieces $N_0$ may be set at approximately 100 pieces.

Next, the allowable range from $l_{min}$ to $l_{max}$ (m) of the length l (m) of the child billet is determined. Here, $l_{min}$ and $l_{max}$ are respectively the minimum value and the maximum value of the length of the child billet allowed on the basis of the predetermined tolerances (outer diameter, wall thickness and length) and the rolling conditions, and the length l of the child billet has the relation shown by the following formula (1), between l and $l_{min}$ and between l and $l_{max}$.

$$l_{min} \leq l \leq l_{max} \quad (1)$$

Then, the allowable range from $L_{min}$ to $L_{max}$ (m) of the length L of the parent billet is determined on the basis of the billet-heating furnace conditions. $L_{min}$ and $L_{max}$ are respectively the minimum length and the maximum length of the billet allowed on the basis of the billet-heating furnace conditions. $L_{min}$ is a value mainly determined by the constraints associated with the heating furnace and others such as the transport rail interval at the time of transportation, and $L_{max}$ is a value mainly determined by the constraint associated with the furnace width of the heating furnace. The length L of the parent billet has the relation shown by the following formula (2), between L and $L_{min}$ and between L and $L_{max}$.

$$L_{min} \leq L \leq L_{max} \quad (2)$$

Here, the length L of the parent billet satisfies the following formula (4) in relation to the length of the child billet, the length l of each of the child billets obtainable from one piece of parent billet, the number $n_B$ of the child billets obtainable from one piece of parent billet and the billet cutting margin.

$$L = l \times n_B + k \times (n_B - 1) \quad (4)$$

In the present invention, it is necessary that the billet-heating-furnace filling factor F represented by the following formula (5) be set not to be lower than the allowable minimum value $F_{min}$ of the heating-furnace filling factor, and in other words, the billet-heating-furnace filling factor F be set to fall within the range satisfying the following formula (3). It is to be noted that the allowable minimum value $F_{min}$ of the heating-furnace filling factor can be determined on the basis of the facility conditions of the heating furnace, the rolling schedule after the heating and others; for example, the concerned minimum value can be set at 60%.

$$F \geq F_{min} \quad (3)$$

$$F = 100 \times L / L_{max} \quad (5)$$

Here, it is preferable to determine the length L of the parent billet and the length l of the child billet and the number $n_B$ of the obtainable child billets, for example, by using the number-of-obtainable-billet indexes $I_0$ and $I_1$ calculated respectively from the following formulas (6) and (7):

$$I_0 = Int((L_{max} + k)/(l_{max} + k)) \quad (6)$$

$$I_1 = Int((L_{max} + k)/(l_{min} + k)) \quad (7)$$

wherein Int(X) means the maximum integer that does not exceed the specified numerical value X.

Then, the case where the number-of-obtainable-billet indexes $I_0$ and $I_1$ are equal to each other ($I_0 = I_1$) means that even when the length l of the child billet is regulated, the number $n_B$ of the obtainable child billets is not varied. In this case, $l_{max}$ is taken as the length l of the child billet, and $I_0$ is taken as the number $n_B$ of the obtainable child billets, and the value of the following formula (4a) obtained by substituting these values into the above-described formula (4) is adopted as the length L of the parent billet. In the case where as described above the number of the obtainable child billets is not increased even when the minimum value is adopted as the length l of the child billet, the length of the child billet set at the largest possible value enables to increase the billet filling factor in the heating furnace, and enables to set the rolling schedule, efficient in productivity, for a long length seamless pipe.

$$L = l_{max} \times I_0 + k \times (I_0 - 1) \quad (4a)$$

In the above-described case of $I_0 = I_1$, namely, in the case where the number of the obtainable child billets cannot be increased, naturally the billet filling factor of the heating furnace cannot be increased. However, when the billet-heating-furnace filling factor F is equal to or larger than the allowable minimum value $F_{min}$ of the heating-furnace filling factor, the length of the billet for use in production of a seamless pipe may be determined by adopting the above-described value. On the other hand, when the billet-heating-furnace filling factor F is less than the allowable minimum value $F_{min}$ of the heating-furnace filling factor, other billet design flows may be adopted in such a way that grouping together with other billets different in length is performed. However, when there is a situation precluding the other billet design flows, namely, for example, when the lot of the other billets different in length is too small, the above-described value as it is may be adopted.

In the case where the above-described number-of-obtainable-billet indexes $I_0$ and $I_1$ are not equal to each other ($I_0 < I_1$), whether or not the billet-heating-furnace filling factor F obtained by substituting the length L of the parent billet obtained with the above-described formula (4a) into the above-described formula (5) satisfies the above-described formula (3) is judged. When the billet-heating-furnace filling factor F is equal to or larger than the allowable minimum value $F_{min}$ of the heating-furnace filling factor, namely, when the billet-heating-furnace filling factor F satisfies the above-described formula (3), L obtained by substituting $n_B = I_0$ and $l = l_{max}$ into the above-described formula (4) is adopted as the length L of the parent billet, $l_{max}$ is adopted as the length l of the child billet, and $I_0$ is adopted as the number $n_B$ of the obtainable child billets. On the other hand, when the billet-heating-furnace filling factor F is less than the allowable minimum value $F_{min}$ of the heating-furnace filling factor, further $L_{max}$ is adopted as the length L of the parent billet, $(L_{max} - k \times (n_B - 1))/n_B$ is adopted as the length l of the child billet, and $I_0 + 1$ is adopted as the number $n_B$ of the obtainable child billets, and thus the length of the billet for use in production of a seamless pipe is determined. In this case, the heating-furnace filling factor is 100%.

EXAMPLE

The advantageous effect of the present invention is described by taking as an example the case where: an order of a lot of "pipes of 244.5 mm in outer diameter, 11.99 mm in wall thickness and 11,000 to 12,500 mm in length, the total sum of the pipe lengths being 15,000 m" was received; a parent billet was heated by using a heating furnace for which the allowable maximum length $L_{max}$ of the parent billet was 11,048 mm; and then by means of a usual pipe-making step, a seamless pipe was produced.

According to a conventional example, in consideration of the scale loss, the billet cutting margin and the like, 600 billets of 225 mm in outer diameter and 5745 mm in length were prepared; these billets were heated and made into pipes to produce 600 seamless pipes of 244.5 mm in outer diameter, 11.99 mm in wall thickness and 25,800 mm in length; then, these seamless pipes were cut to obtain 1,200 seamless steel pipes of 12,500 mm in length. The total length of the obtained seamless steel pipes was 15,000 m.

The billet filling factor F of the heating furnace in this case was about 51.8%. The throughput of the heating furnace was 130 ton/hr to fall behind the throughput of the subsequent pipe-making step, and thus to lead to a condition such that the production efficiency was restricted by the throughput of the heating furnace. The specific energy consumption required for heating the billets was 330 Mcal/ton.

On the other hand, in the example of the present invention, 312 parent billets of 225 mm in outer diameter and 11,048 mm in length were prepared; the parent billets were heated and then cut into child billets of 225 mm in outer diameter and 5,521 mm in length (the number of the child billets was 624); these child billets were subjected to pipe-making to produce 624 seamless pipes of 244.5 mm in outer diameter, 11.99 mm in wall thickness and 24,800 mm in length; the obtained seamless pipes were cut to obtain 1248 seamless steel pipes of 12,000 mm in length. The total length of the obtained seamless pipes was 14,976 m.

In this case, the billet filling factor F of the heating furnace was about 99.5%, and the throughput of the heating furnace was increased up to 150 ton/hr. The specific energy consumption required for heating the billets was able to be reduced to 280 Mcal/ton.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

Industrial Applicability

According to the present invention, the billet filling factor in the heating furnace can be increased, and hence the energy saving in the production of seamless pipes can be realized, and the productivity in the production of seamless pipes can also be improved.

The invention claimed is:

1. A method for producing a seamless pipe comprising steps of a billet-heating process, a billet-cutting process, a piercing-rolling process and elongation-rolling process, wherein:

the method using the billets satisfying the following formulas (1) to (3):

$$l_{min} \le l \le l_{max} \quad (1)$$

$$L_{min} L \le L_{max} \quad (2)$$

$$F \ge F_{min} \quad (3)$$

wherein L is the length (m) of the parent billet and is represented by the following formula (4), and F is the billet-heating-furnace filling factor (%) and is represented by the following formula (5):

$$L = l \times n_B + k \times (n_B - 1) \quad (4)$$

$$F = 100 \times L / L_{max} \quad (5)$$

wherein in the above-described formulas, the meanings of the individual symbols are as follows:

$L_{min}$: The minimum length (m) of the parent billet allowed on the basis of the conditions of the billet-heating furnace $L_{max}$: The maximum length (m) of the parent billet allowed on the basis of the conditions of the billet-heating furnace l: The length (m) of the child billet $l_{min}$: The minimum value (m) of the length of the child billet allowed on the basis of the predetermined tolerances and the rolling conditions $l_{max}$: The maximum value (m) of the length of the child billet allowed on the basis of the predetermined tolerances and the rolling conditions k: Billet cutting margin (m)

$n_B$: The number (number of pieces) of the child billets obtainable from one piece of parent billet $F_{min}$: The allowable minimum value (%) of the heating-furnace filling factor wherein, the method adopts the following respective values in the following respective cases (A) to (C) in each of which the relation between the number-of-obtainable-billet indexes $I_0$ and $I_l$ calculated respectively from the following formulas (6) and (7) is specified:

(A) A case where $I_0 = I_l$:

L obtained by substituting $n_B = I_0$ and $l = l_{max}$ into the above-described formula (4) is adopted as the length L of the parent billet, $l_{max}$ is adopted as the length l of the child billet, and $I_0$ is adopted as the number $n_B$ of the obtainable child billets (B) A case where $I_0 < I_l$, and F satisfies the above-described formula (3) wherein F is obtained by substituting, into the above-described formula (5), L obtained by substituting $n_B = I_0$ and $l = l_{max}$ into the above-described formula (4):

L obtained by substituting $n_B = I_0$ and $l = l_{max}$ into the above-described formula (4) is adopted as the length L of the parent billet, $l_{max}$ is adopted as the length l of the child billet, and $l_0$ is adopted as the number $n_B$ of the obtainable child billets (C) A case where $I_o < I_l$, and F does not satisfy the above-described formula (3) wherein F is obtained by substituting, into the above-described formula (5), L obtained by substituting $n_B = I_0$ and $l = l_{max}$ into the above-described formula (4):

$L_{max}$ is adopted as the length L of the parent billet, $(L_{max} - k \times n_B - l))/n_B$ is adopted as the length l of the child billet, and $I_0 + l$ is adopted as the number $n_B$ of the obtainable child billets $$I_0 = \mathrm{Int}((L_{max} + k)/(l_{max} + k)) \quad (6)$$

$$I_l = \mathrm{Int}((L_{max} + k)/(l_{min} + k)) \quad (7)$$

wherein Int(X) means the maximum integer that does not exceed the specified numerical value X.

2. A method for cutting a billet for use in a seamless pipe, comprising cutting the billet to a length determined so as to satisfy the following formulas (1) to (3):

$$l_{min} \le l \le l_{max} \quad (1)$$

$$L_{min} \le L \le L_{max} \quad (2)$$

$$F \ge F_{min} \quad (3)$$

wherein L is the length (m) of the parent billet and is represented by the following formula (4), and F is the billet-heating-furnace filling factor (%) and is represented by the following formula (5):

$$L=l\times n_B+k\times(n_B-1) \quad (4)$$

$$F=100\times L/L_{max} \quad (5)$$

wherein in the above-described formulas, the meanings of the individual symbols are as follows:

$L_{min}$: The minimum length (m) of the parent billet allowed on the basis of the conditions of the billet-heating furnace $L_{max}$: The maximum length (m) of the parent billet allowed on the basis of the conditions of the billet-heating furnace l: The length (m) of the child billet $l_{min}$: The minimum value (m) of the length of the child billet allowed on the basis of the predetermined tolerances and the rolling conditions $l_{max}$: The maximum value (m) of the length of the child billet allowed on the basis of the predetermined tolerances and the rolling conditions k: Billet cutting margin (m)

$n_B$: The number (number of pieces) of the child billets obtainable from one piece of parent billet $F_{min}$: The allowable minimum value (%) of the heating-furnace filling factor wherein the method adopts the following respective values in the following respective cases (A) to (C) in each of which the relation between the number-of-obtainable-billet indexes $I_0$ and $I_l$ calculated respectively from the following formulas (6) and (7) is specified.

(A) A case where $I_0=I_l$:

L obtained by substituting $n_B$=and $I_0$ and $l=l_{max}$ into the above-described formula (4) is adopted as the length L of the parent billet, $l_{max}$ is adopted as the length l of the child billet, and $I_0$ is adopted as the number $n_B$ of the obtainable child billets (B) A case where $I_0<I_l$, and F satisfies the above-described formula (3) wherein F is obtained by substituting, into the above-described formula (5), L obtained by substituting $n_B=I_0$ and $l=l_{max}$ into the above-described formula (4):

L obtained by substituting $n_B=I_0$ and $l=l_{max}$ into the above-described formula (4) is adopted as the length L of the parent billet, $l_{max}$ is adopted as the length l of the child billet, and $l_0$ is adopted as the number $n_B$ of the obtainable child billets (C) A case where $I_0<I_l$, and F does not satisfy the above-described formula (3) wherein F is obtained by substituting, into the above-described formula (5), L obtained by substituting $n_B=I_0$ and $l=l_{max}$ into the above-described formula (4):

$L_{max}$ is adopted as the length L of the parent billet, $(L_{max}-k\times(n_B-1))/n_B$ is adopted as the length l of the child billet, and $I_0+l$ is adopted as the number $n_B$ of the obtainable child billets $$I_0=\mathrm{Int}((L_{max}+k)/(l_{max}+k)) \quad (6)$$

$$I_l=\mathrm{Int}((L_{max}+k)/(l_{min}+k)) \quad (7)$$

wherein Int(X) means the maximum integer that does not exceed the specified numerical value X.

* * * * *

UNITED STATES PATENT AND TRADEMARK OFFICE

CERTIFICATE OF CORRECTION

PATENT NO. : 8,770,003 B2
APPLICATION NO. : 12/883887
DATED : July 8, 2014
INVENTOR(S) : Kenichi Sasaki It is certified that error appears in the above-identified patent and that said Letters Patent is hereby corrected as shown below:

In the Claims

Column 9, Line 17, in Claim 2, delete "$L_{min}$:" and insert -- $l_{min}$: --, therefor.

Column 10, Line 29, in Claim 2, delete "$1_{mim}$" and insert -- $l_{min}$ --, therefor.

Signed and Sealed this
Twenty-first Day of October, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,770,003 B2
APPLICATION NO. : 12/883887
DATED : July 8, 2014
INVENTOR(S) : Kenichi Sasaki It is certified that error appears in the above-identified patent and that said Letters Patent is hereby corrected as shown below:

On the title page

At column 1, item (73), the Assignee "Sumitomo Metal Industries, Ltd., Osaka-shi (JP)" should be

--Nippon Steel & Sumitomo Metal Corporation, Tokyo (JP)--

Signed and Sealed this
Twenty-first Day of July, 2015

Michelle K. Lee

Michelle K. Lee
*Director of the United States Patent and Trademark Office*